United States Patent [19]

Barr et al.

[11] Patent Number: 4,640,375

[45] **Date of Patent: * Feb. 3, 1987**

[54] DRILL BIT AND CUTTER THEREFOR

[75] Inventors: John D. Barr, Gloucestershire; John M. Fuller, Stroud, both of United Kingdom

[73] Assignee: NL Industries, Inc., New York, N.Y.

[ * ] Notice: The portion of the term of this patent subsequent to Nov. 19, 2002 has been disclaimed.

[21] Appl. No.: 578,182

[22] Filed: Feb. 8, 1984

Related U.S. Application Data

[63] Continuation-in-part of Ser. No. 443,657, Nov. 22, 1982, Pat. No. 4,505,342.

[51] Int. Cl.[4] ..... E21B 10/46

[52] U.S. Cl. ..... 175/410; 175/329

[58] Field of Search ..... 175/410, 329, 330, 339, 175/412, 327; 407/42, 33, 116, 118

[56] References Cited

U.S. PATENT DOCUMENTS

| | | | |
|---|---|---|---|
| 4,140,189 | 2/1979 | Garner | 175/410 |
| 4,200,159 | 4/1980 | Peschel et al. | 175/329 |
| 4,351,401 | 9/1982 | Fielder | 175/410 |
| 4,478,297 | 10/1984 | Radtke | 175/410 |
| 4,553,615 | 11/1985 | Grainger | 175/329 |
| 4,558,753 | 12/1985 | Barr | 175/329 |
| 4,593,777 | 6/1986 | Barr | 175/329 |

*Primary Examiner*—Stephen J. Novosad
*Assistant Examiner*—Bruce M. Kisliuk
*Attorney, Agent, or Firm*—Browning, Bushman, Zamecki & Anderson

[57] ABSTRACT

The invention comprises a drag-type drill bit including a bit body adapted for rotative movement in a pre-determined direction in use and having an operating end face, and a plurality of cutting members mounted in the bit body. Each of the cutting members has a stud portion disposed in a respective recess in the bit body and defining the inner end of the cutting member, and a cutting face generally adjacent its outer end facing outwardly through the operating end face of the bit body and terminating in an outermost cutting edge. The centerline of the stud portion is rearwardly inclined, from the outer end to the inner end, with respect to the direction of movement in use, taken at the midpoint of the cutting edge, at a first angle from 80° to 30° inclusive. The cutting face is oriented such that the tangent to the cutting face at the midpoint of the cutting edge and in the central plane of the cutting member is disposed at a second angle, from 18° to 75° inclusive, with respect to the centerline of the stud portion.

18 Claims, 12 Drawing Figures

FIG. 2
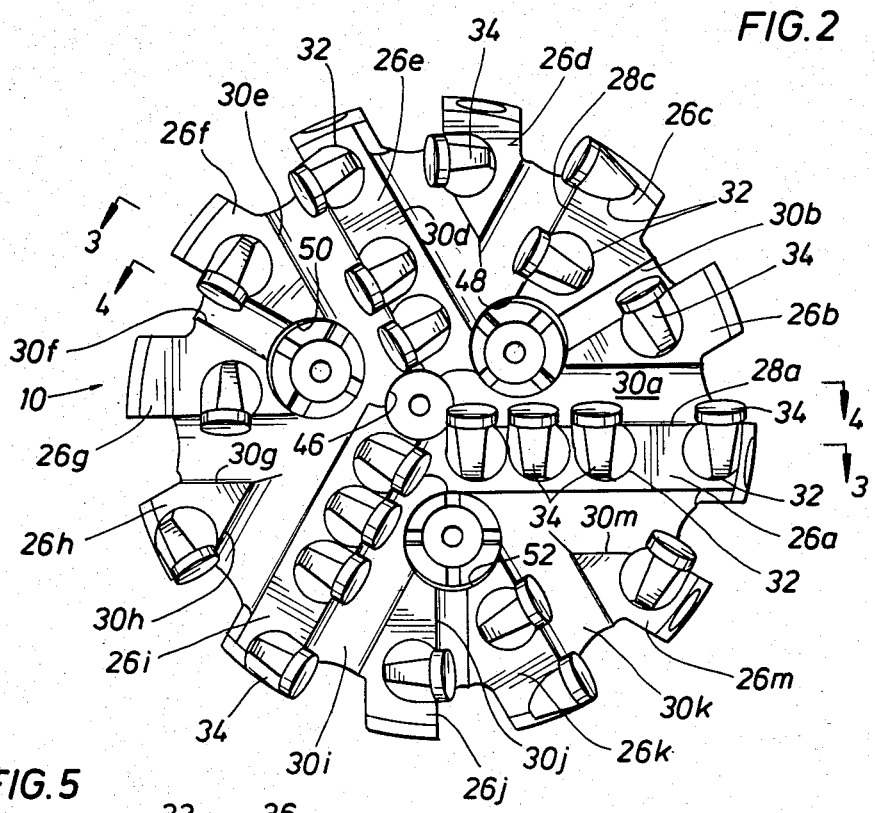
FIG. 5
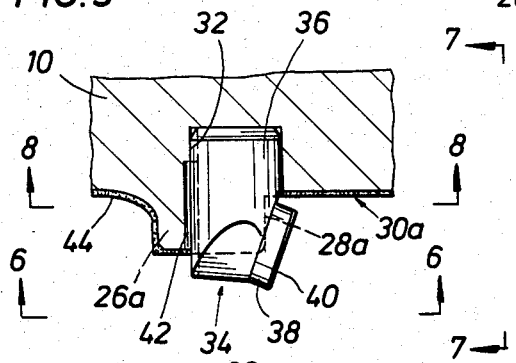
FIG. 7
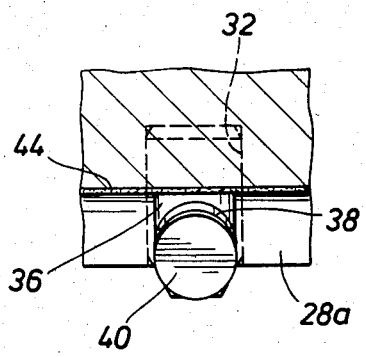
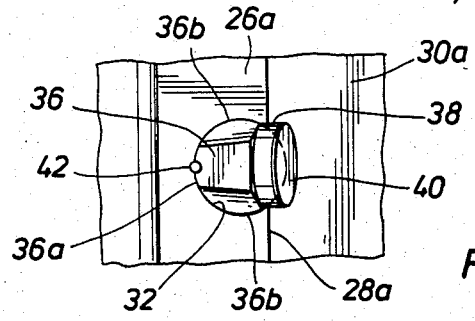
FIG. 6

DRILL BIT AND CUTTER THEREFOR

CROSS-REFERENCE TO RELATED APPLICATION

This is a continuation-in-part of U.S. application Ser. No. 443,657, filed Nov. 22, 1982 now U.S. Pat. No. 4,505,342.

BACKGROUND OF THE INVENTION

It has become common practice to dress drag type well drilling bits with cutting elements made of polycrystalline diamond compacts, or "PDC." Unlike a roller type drill bit, which primarily crushes the earth formation being drilled, a drag type bit more typically actually cuts or chips the earth formation. Thus, the use of diamond in the cutting elements is especially important in drag type bits in order to increase their life. The polycrystalline diamond material typically is supplied in the form of a relatively thin layer on one face of a substantially larger mounting body. The mounting body is usually post-like in configuration, and formed of a relatively hard material such as sintered tungsten carbide. The diamond layer may be mounted directly on the mounting body, or it may be mounted via an intermediate disc-like carrier, also comprised of sintered tungsten carbide. In any event, the diamond layer is disposed toward one end of the mounting body, the other end of which is mounted in a bore, pocket, or recess in the body of the drilling bit.

The bit body itself may be formed of a tungsten carbide matrix. Traditionally, drag bit bodies have also been made of various forms of steel. One problem which has been associated with the use of PDC type cutting members in such drag bit bodies has been damage to and/or loss of these cutting members. This may occur by cracking and shearing of the stud-like mounting body, which carries the diamond layer, near the outer surface of the bit body. Cutting members may also be lost when the mounting bodies become completely dislodged from the recesses in which they are mounted.

U.S. Pat. No. 4,244,432 discloses one form of prior drag bit. Although the bit has a pin and substructure of metal, it is essentially a tungsten carbide matrix type bit in that it comprises a thick layer of such matrix forming the operating end face and extending inwardly therefrom so that the recesses for mounting of the cutting members, as well as the circulation port system, are all formed of the tungsten carbide matrix. This outer matrix portion of the bit has a stepped configuration which, to a certain extent, provides improved support for the mounting bodies of the cutting members. However, the use of tungsten carbide matrix material for forming any substantial part of a bit body entails a number of disadvantages. In the first place, the tungsten carbide matrix material is per se relatively expensive. Furthermore, while highly wear resistant, this material lacks resiliency and is relatively susceptible to cracking and similar type damage. This last characteristic effectively limits the types of manufacturing procedures which may be utilized in forming matrix type bits. For example, any substantial amount of machining of such bits is highly impractical, and the essential configuration of the matrix body must be achieved by other techniques, essentially analogous to casting. Furthermore, it is extremely difficult to mount the cutting members in the recesses in the matrix bit body with an interference fit without damaging the bit body, the cutting members or both. Therefore, as a practical matter, the mounting bodies of the cutting members must be brazed into the recesses in the bit body. These more complicated manufacturing techniques, which are necessitated by the use of tungsten carbide matrix in the bit body, further increase the cost of the bit. Indeed, successful manufacturing of matrix type bits requires particular skill, expertise, and "art" not typically possessed by the average shop hand. Still another disadvantage of the matrix type bit body is its relatively poor thermal conductivity.

A number of the above disadvantages of matrix type bit bodies could, at least theoretically, be ameliorated by the use of a generally non-frangible metallic material, such as a suitable steel, for use in forming the bulk of the bit body. However, although there have been numerous efforts, beginning in the early to mid 1970's, to develop steel body drag bits with PDC cutting members, such efforts have not been entirely successful and, in particular, have not provided an adequate solution to the problem of damage and/or loss of the cutting members in use. Some of the earliest steel body PDC bits included a number of bores each with a concentric counterbore, the pairs of bores being located at various positions about the operating or cutting face of the bit body. The innermost bore of each pair provided the recess for mounting of the mounting body of the cutting member, whereas the larger but shallower outer bore provided access to the entirety of the diamond cutting face, theoretically for cooling and cleaning by the drilling mud. However, it was found that the mounting bodies of the cutting members on such bits did tend to crack or shear off as described hereinabove. Furthermore, the cooling and cleaning of the cutting faces by the drilling mud with such arrangements was less than satisfactory.

U.S. Pat. Nos. 4,323,130 and 4,265,324 illustrate efforts to improve upon the last-mentioned design by providing eccentric, rather than concentric, counterbores. Although these concentric arrangements provided some additional support for the mounting body of the cutting member in the area opposite the cutting face, still further improvements were desired. Additionally, the concentric counterbore scheme did not significantly improve the cooling and cleaning characteristics of the more basic concentric counterbore arrangement.

SUMMARY OF THE INVENTION

Certain aspects of the present invention are concerned primarily with solving the problems previously encountered in metallic body drag bits utilizing PDC type cutting members and, more particularly, with specific attention to full bore, as opposed for example to core head, type well drilling bits. The present invention not only alleviates the problems previously associated with these types of bits, but further positively utilizes the characteristics of the steel or other generally non-frangible metal of the bit body to provide even further advantages. Nevertheless, certain aspects of the present invention can also be advantageously employed in other types of bits, such as tungsten carbide matrix bits.

A bit according to the present invention comprises a bit body having an operating end face whose general configuration or profile includes a plurality of upsets each having a leading edge surface and at least one recess extending through such leading edge surface. The profile of the end face of the bit body further comprises a plurality of flow paths. Each of the leading edge surfaces of the upsets has one of these flow paths extending therealong and inset therefrom. As indicated hereinabove, it is preferably that the bit body be comprised of a generally non-frangible metallic material, such as steel, such material essentially defining the aforementioned profile, with the recesses extending into such metallic material. It is also preferable that at least some of the upsets have a plurality of such recesses spaced therealong.

The bit further comprises a plurality of cutting members carried by the bit body. Each of these cutting members includes an elongate mounting body and a cutting formation or cutting face on the exterior of the mounting body adjacent one end thereof. At least a majority of the mounting bodies on the bit are mounted in respective ones of the recesses in the upsets with their cutting formations facing outwardly along the leading edge surfaces of the upsets.

This upset arrangement, with the recesses extending into the leading edge surfaces of the upsets, makes it possible to provide much better support for the end of the mounting body carrying the cutting formation. For example, that end of the mounting body may be embedded in and supported by the aforementioned metallic material not only on the trailing side generally opposite the cutting formation but also in lateral areas adjacent the cutting formation. For example, in preferred embodiments, the walls of the recess but the respective mounting body about significantly more than 180° of its periphery measured in a plane transverse to the cutting face or cutting formation. This structural relationship helps to alleviate the cracking and shearing problems described above, and these problems are further remedied by the use of a non-frangible metallic material such as steel which, unlike a tungsten carbide matrix, is relatively resilient and can give to accommodate the forces imposed on the cutting member.

The upsets are preferably in the form of elongate ribs, each arranged to have a substantial radial component of direction, with respect to the end face of the bit body, at each point along its length. For those cutting members whose mounting bodies are mounted in recesses in these ribs, the cutting formations are fully exposed along the leading edge surfaces of the ribs, without the need for individual counterbores. The cutting formations may be generally planar cutting faces, and the bit body has a plurality of circulation ports opening through its end face. The number of such ports is preferably less than the number of flow paths extending along the leading edges of the ribs, and at least some of the ports communicate with more than one such flow path.

This arrangement, with relatively few ports, permits relatively high volume flow through each port, while the rib and flow path arrangement and its relationship to the ports organizes and directs the fluid flow to ensure improved cleaning and cooling of the cutting faces. The use of the elongate flow paths, as opposed to individual counterbores about each cutting member, also tends to reduce the problem of erosion of the bit body in the areas forward of the cutting members. Furthermore, for those cutting members whose mounting bodies are mounted in recesses in the ribs, each of the cutting faces lies generally coplanar to the next adjacant cutting face or faces on the same rib. Thus, the cutting faces themselves help to direct the fluid flow across one face and onto the next adjacent one. Additional cooling is provided by heat conduction through the metallic bit body, particularly enhanced by the substantial contact of this metallic material about a large portion of the periphery of the outer end of the mounting body of the cutting member, as described above.

The fact that there are relatively few circulation ports also permits each such port (or the nozzle therein) to have a relatively larger inner diameter, thereby reducing the possibility of clogging of the ports.

The use of a generally non-frangible metallic material also facilitates the manufacturing procedure by permitting the use of relatively easy machining processes to form the ribs and flow paths, recesses, and circulation ports. It is then also possible to mount the mounting bodies of the cutting members in their respective recesses with interference fits, e.g. by press fitting or shrink fitting.

Another aspect of the invention pertains to improvements in the configuration of the individual cutting member, and its orientation with respect to the bit body. This aspect of the invention lessens the deleterious effects of the forces which are imposed on the cutting member in use. Although this aspect of the invention can be used along, when further combined with the aforementioned aspects of the invention, most notably the use of the upset on the bit body to provide back support for the outer end of the cutting member, the protection of this member from damage is even further enhanced as the two aspects of the invention cooperate with each other.

The aforementioned cutting formation or cutting face terminates in an outermost cutting edge which actually engages the earth formation, and it is convenient, for present purposes, to measure the direction of movement at the midpoint of this cutting edge. During drilling, major forces are exerted on the outer end of the cutting member in two directions, upwardly generally normal to the earth formation, and rearwardly with respect to the direction of travel or movement as the bit is rotated. The resultant force thus has both upward and rearward components, and a vector representing the resultant force is inclined rearwardly and inwardly with respect to the bit.

The mounting body of the cutting member may be said to have a stud portion, being that portion of the mounting body which is directly engaged in the respective recess or pocket in the bit body. In accord with the present invention, the centerline of the stud portion is rearwardly inclined from the outer end to the inner end with respect to the direction of movement in use, taken at the midpoint of the cutting edge, at a first angle which may be from 80° to 30° inclusive, but even more preferably, from 65° to 50° inclusive. By this means, the stud portion is inclined generally in the same sense as the resultant of the aforementioned major forces. Accordingly, by an increase in the more tolerable compression force, the more dangerous bending and shear forces are reduced. This is highly instrumental in preventing breakage and failure of the cutting member.

Furthermore, by orienting the cutting face (more specifically the tangent to the cutting face at the midpoint of the cutting edge and in the central plane of the cutting member) at a second angle with respect to the stud centerline, which angle may be from 18° to 75° inclusive, but more preferably from 25° to 60° inclusive, desirable back rake angles may be provided while accommodating the aforementioned inclination of the stud portion.

It is a principal object of the present invention to provide an improved metallic body full bore drag bit designed to provide enhanced support for the outer ends of PDC type cutting members.

Another object of the present invention is to provide for improved cooling and cleaning of the PDC cutting members in such a bit by both convection and conduction.

A further object of the present invention is to provide improved fluid flow characteristics in and over a drag type drilling bit.

Still another object of the present invention is to provide a full bore drag type bit which is more effective, and yet less expensive to manufacture, than prior bits.

Yet another object of the present invention is to provide a drill bit and a cutting member therefor in which damage in use is minimized by the inclination of the stud portion of the cutting member in the bit body and/or the inclination of said stud portion with respect to the cutting face.

Still other objects, features and advantages of the present invention will be made apparent by the following detailed description, the drawings and the claims.

BRIEF DESCRIPTION OF THE DRAWINGS

FIG. 2 is a plan view of the operating end face of the drill bit taken along the line 2—2 in FIG. 1.

FIG. 5 is an enlarged detailed sectional view through one of the ribs and recesses, showing the respective cutting member in elevation.

FIG. 6 is a detailed plan taken along the line 6—6 in FIG. 5.

FIG. 7 is a detailed view taken along the line 7—7 in FIG. 5.

DETAILED DESCRIPTION

Figure 1:
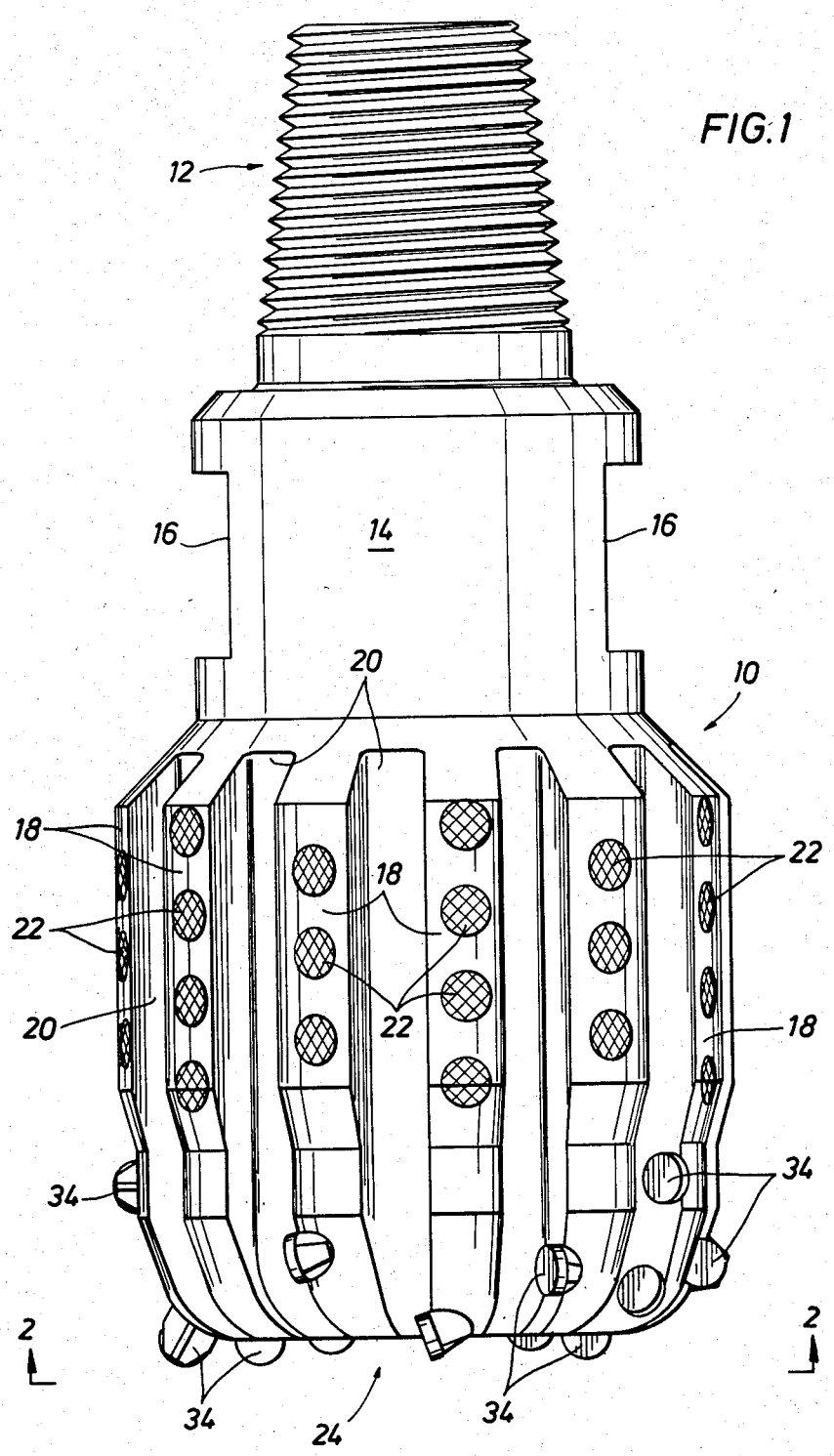
FIG. 1 is an elevational view of a drill bit according to the present invention.

Referring first to FIGS. 1 and 2, there is shown a full bore drag type drill bit according to the present invention. The bit includes a bit body 10 formed of steel or similar generally non-frangible metallic material, preferably having significant resiliency, as compared for example to tungsten carbide material, and also having relatively high heat conductivity. The bit body defined by such metallic material includes an uppermost pin 12 for connecting the bit to the lower end of a drill string. Below pin 12 is a neck 14 having bit breaker slots 16 which may be engaged by a suitable bit breaker plate for making up or breaking out the aforementioned connection to the drill string. Below neck 14, the bit body 10 widens to form a stabilizer section including alternating stabilizer blades 18 and junk slots 20. Stabilizer blades 18 have buttons 22 of hard material such as tungsten carbide embedded therein to help reduce wear.

The lowermost end of bit body 10 defines the cutting or operating end face 24, best shown in FIG. 2. Face 24 of the bit body includes a number of upsets in the form of ribs **26*a*–26*m*. The innermost ends of these ribs are located at various distances from the centerline of the bit body, each rib extending generally outwardly from its respective inner end in a direction which, while not truly radial, has a substantial radial component with respect to end face 24 of the bit body. Each of the ribs 26*a*–26*m* is continuous with a respective one of the stabilizer blades 18**.

Each of ribs **26*a*–26*m* has a respective leading edge surface with respect to the intended direction of rotation of the bit. For example, the leading edge surface of rib 26*a* is shown at 28*a*, and the leading edge surface of rib 26*c* is shown at 28*c*. For convenience, these leading edge surfaces will be referred to herein as being "generally perpendicular" to the overall profile of end face 24, shown in FIG. 4**, and thus to the profile of the earth formation being drilled. This term is used only in the most general sense, and should not be construed as excluding bits in which the ribs and their leading edge surfaces have some rake angle.

Alternating between ribs **26*a*–26*m* are a plurality of channel-like flow paths 30*a*–30*m*. Each of these flow paths extends along the leading edge surface of a respective one of the ribs 26*a*–26*m*, and is inset from that rib. Each of the flow paths 30*a*–30*m* is also continuous with a respective one of the junk slots 20 in the stabilizer portion of the bit body. Each of the ribs 26*a*–26*m* has at least one recess 32 opening through its leading edge surface and extending into the metal of the bit body. In the embodiment shown, each of the recesses 32 opens not only through the leading edge surface of its respective rib, but also opens generally axially outwardly through the outermost part of the rib, the opening of the recess traversing the corner formed between the leading edge surface and the longitudinally outermost surface of the rib. Although some of the shorter ribs have only a single recess therein, as shown in FIG. 2, at least some of the ribs, such as ribs 26*a*, 26*c* and 26*e***, have an array of recesses spaced therealong.

The bit further comprises a plurality of cutting members 34. An exemplary one of these cutting members, specifically one of those associated with rib **26*a*, is shown in detail in FIGS. 5–8. The cutting member 34 includes an elongate mounting body 36 formed of a hard material such as sintered tungsten carbide. Mounting body 36 has one end mounted in a respective one of the recesses 32. That portion of body 36 which is disposed in recess 32 will be referred to herein as the "stud portion" of the mounting body. The opposite end of member 36 extends outwardly through the mouth of the recess 32. Adjacent said outer end of the mounting body 36 and, more specifically, on that side which faces outwardly through the respective leading edge surface 28*a* of the rib 26*a*, there is mounted, as by bonding, a disc-shaped carrier 38, also formed of sintered tungsten carbide. On the outer surface of carrier 38 there is a layer 40 of polycrystalline diamond material, which serves as the cutting formation or cutting face of member 34. Cutting face 40 terminates in an outermost cutting edge 40*a* which engages the earth formation in use. Although cutting face 40 may have a suitable vertical or horizontal rake angle, it is arranged to face outwardly along, and lie generally parallel to, the respective leading edge surface 28a of the rib in which member 34 is mounted. Preferably, the mounting body 36 is interference press fitted into its recess 32. In order to key the cutting member to the proper orientation, with cutting face 40 facing outwardly through the leading edge 28a of rib 26a, the trailing side of the mounting body 36 and recess 32 are provided with small opposed grooves for receipt of a key pin shown at 42 in FIGS. 5 and 6. Alternatively, it is possible to provide only the groove in body 36**, as the material of the bit body will be deformed into this groove during the interference fitting process to form an integral key.

By placing the opening of recess 32 in leading edge 28a and, more specifically, at the outermost corner of such leading edge, it is possible to allow full exposure of cutting face 40 through such leading edge without a counterbore about recess 32, while a significant portion of the adjacent outermost end of mounting body 36 is embedded in and supported by the metallic material of rib 26a. By comparison of FIGS. 5, 6 and 7, it can be seen that, at the outer end of mounting body 36, not only the trailing side 36a opposite cutting face 40, but also lateral portions 36b generally adjacent face 40 and its carrier 38 are thus embedded and supported. Indeed, it can be seen that the walls of recess 32 abut the outer end of the mounting body 36 about significantly more than 180° of its periphery, when viewed in a plane transverse to cutting face 40 (see FIGS. 6 and 8). This relatively large amount of abutment and support near cutting face 40 helps to prevent cracking and/or breaking of mounting body 36 in use, and this effect is further enhanced by the inherent resiliency of the steel of which the bit body is formed, which can give to accommodate the forces imposed on the cutting member 34 in use.

In finished form, the bit body is coated with a thin layer 44 of tungsten carbide matrix or the like. However, this coating 44 is sufficiently thin that it does not significantly affect the aforementioned advantages of the use of steel to form the major part of the bit body. More specifically, it can be seen than the recess 32 extends into the steel, and that the steel defines the bulk of rib 26a and, in particular, the portion which supports the outer end of mounting body 36.

Each of the other cutting members 34 is similarly mounted in a respective one of the recesses 32 in the various ribs 26a–26m. The cutting members of adjacent ribs are staggered in the generally radial direction, so that each cutting face 40 traverses the earth's formation at a slightly different distance from the centerline of the bit, and together, the cutting faces 40 cover substantially the entire end of the borehole in use.

Figure 3:
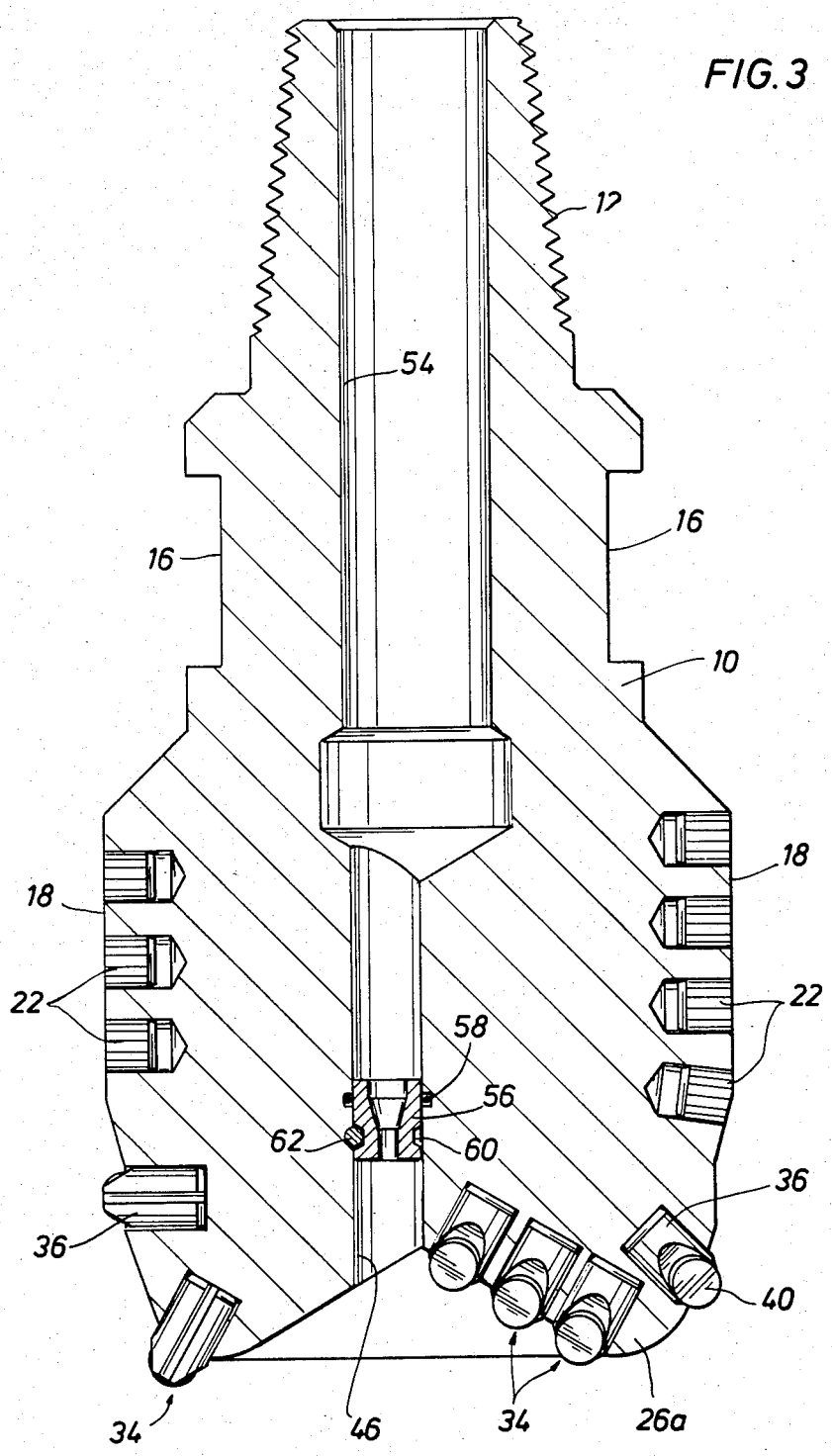
FIG. 3 is a vertical cross-sectional view taken along the line 3—3 of FIG. 2.
Figure 4:
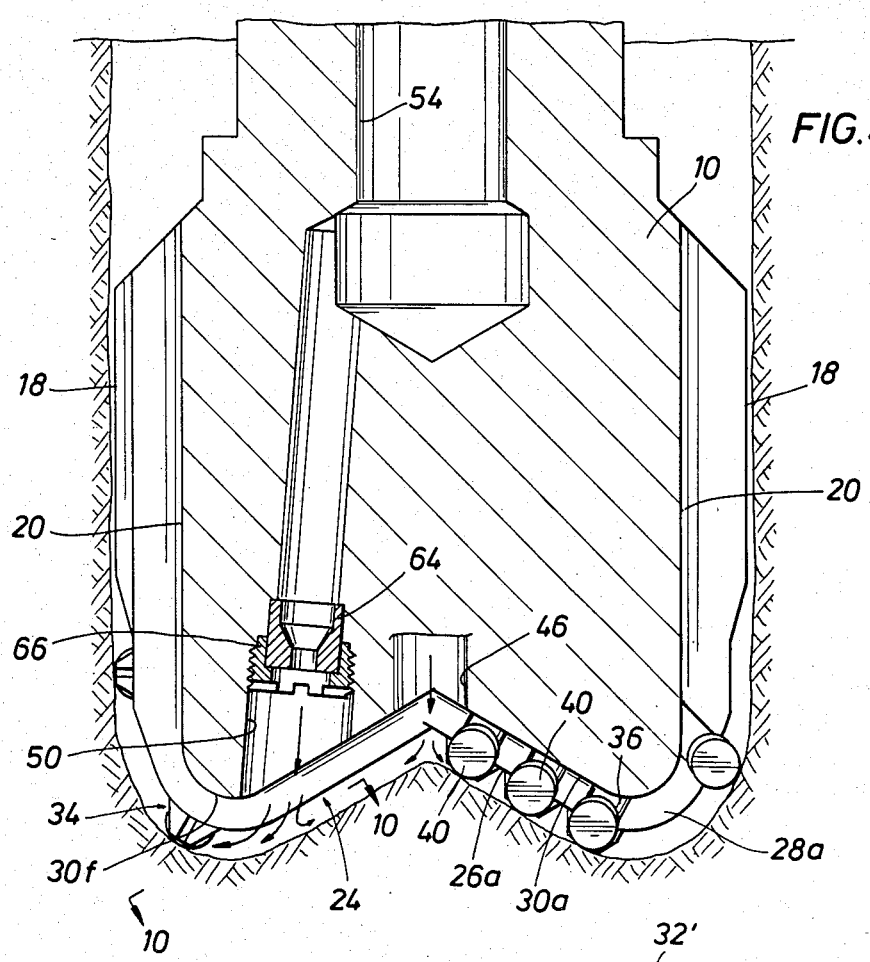
FIG. 4 is a vertical cross-sectional view taken along the line 4—4 of FIG. 2.
Figure 8:
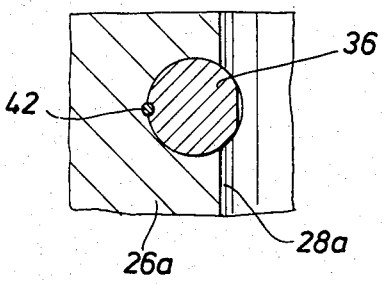
FIG. 8 is a detailed view taken along the line 8—8 of FIG. 5.

Referring now again to FIG. 2, further in conjunction with FIGS. 3 and 4, a plurality of circulation ports 46, 48, 50 and 52 open through end face 24 at varying distances from its centerline each in communication with several of the flow paths 30a–30m. Each of these ports is defined by a rectilinear bore which intersects the larger central bore 54 of the bit body. Each of these smaller rectilinear bores is provided with a removable nozzle fitting. As shown in FIG. 3, the fitting 56 for innermost bore 46 is sealed with respect to that bore by an O-ring 58 carried in an annular groove in the bit body. Nozzle fitting 56 has an external annular groove 60. A nail 62 extends through groove 60 and is also received in an aligned internal groove in bore 46 to removably mount nozzle 56 in that bore in a manner already known in the art. The remaining nozzle fixtures are exemplified by fixture 64 shown in FIG. 4. Nozzle 64 is bottomed against a shoulder formed in bore 50. The outermost part of bore 50 is further enlarged and tapped to receive an externally threaded retaining ring 66 for nozzle 64.

Figure 10:
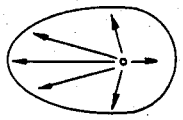
FIG. 10 is a diagramatic view taken along the line 10—10 of FIG. 4 illustrating a fluid flow pattern.

Still referring to FIG. 4, the central portion of end face 24 of the bit body is inwardly concave, more specifically having a generally conical profile. Each of the circulation ports, other than the innermost port 46, has a centerline which intersects the end face 24 of the bit body (and thus the corresponding end face of the borehole) at an angle of about 0° to 40° from the normal to end face 24 at that point. This causes fluid emerging from the port to tend to disperse in a somewhat egg-shaped pattern as shown in FIG. 10. Thus, the tendency is for the major part of the fluid emerging from the port to flow radially outwardly through the adjacent flow path or paths 30a–30m 30m and carry cuttings upwardly through junk slots 20.

Each of the circulation ports 46, 48, 50 and 52 communicates with more than one of the flow paths 30a–30m. Thus, only four ports can adequately service 12 flow paths and an equal number of ribs. Such a relationship, i.e. with the number of ports being less than the number of flow paths and ribs, is preferred since it allows a greater volume of flow through each of the ports and for each nozzle to have a sufficiently large I.D. to ensure against clogging.

The alternating ribs and flow paths, with the latter communicating with the circulation ports, and the former carrying the cutting members such that the cutting faces 40 face into said flow paths, organizes the fluid flow to best insure that each cutting face 40 is washed and cooled by the circulating fluid. Indeed, the cutting faces 40 themselves on each respective rib lie generally parallel, and more specifically nearly coplanar, to the adjacent cutting face or faces on the same rib so that each cutting face tends to direct the fluid thereacross and toward the next adjacent cutting face. In this sense, "parallel" and "coplanar" are used in a very general sense. Thus, the ribs 26a–26m could be provided with a slight curvature, with the cutting faces shifted accordingly, and the adjacent cutting faces on such a rib would still be considered generally "parallel" and "coplanar."

The cutting members are further cooled by conduction of heat through the steel of the bit body, and this effect is enhanced by the substantial abutment of the outer ends of the mounting bodies of the cutting members by their respective recess walls as described hereinabove.

The steels and similar metal preferably used for bit body 10, unlike tungsten carbide matrix, are easily machinable to form the alternating rib/channel pattern of the end face as well as the bores 46, 48, 50, 52 and 54. Such metals also readily permit attachment of bodies 36 by interference fits.

Figure 9:
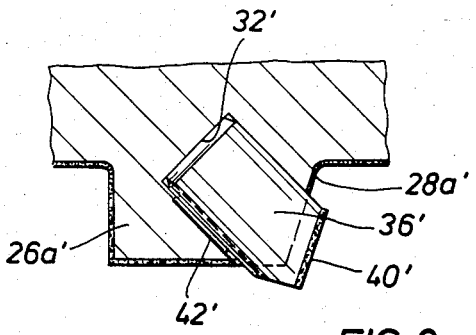
FIG. 9 is a detailed view, similar to that of FIG. 5, showing a modification.

Cutting members could be provided in other forms than those shown in FIGS. 1–8, in which case the configuration of the recesses would be altered accordingly. However, it is always desirable that the mouth of the recess open through the leading edge surface of the respective rib, more specifically at the outermost corner thereof, and extend into the metallic material of the rib. For example, FIG. 9 shows a variation in which the diamond layer 40' is applied more nearly on the axial end of mounting body 36', rather than in a more lateral orientation. It can be seen how the orientation of recess 32' in rib 26a' has been correspondingly altered, so that the mouth of the recess still opens through the leading edge surface 28a'. Another variation illustrated in the embodiment of FIG. 9 is the application of the diamond layer 40' directly to the stud-like mounting body 36', rather than on an intermediate carrier disc such as 38 of the preceding embodiments.

Figure 11:
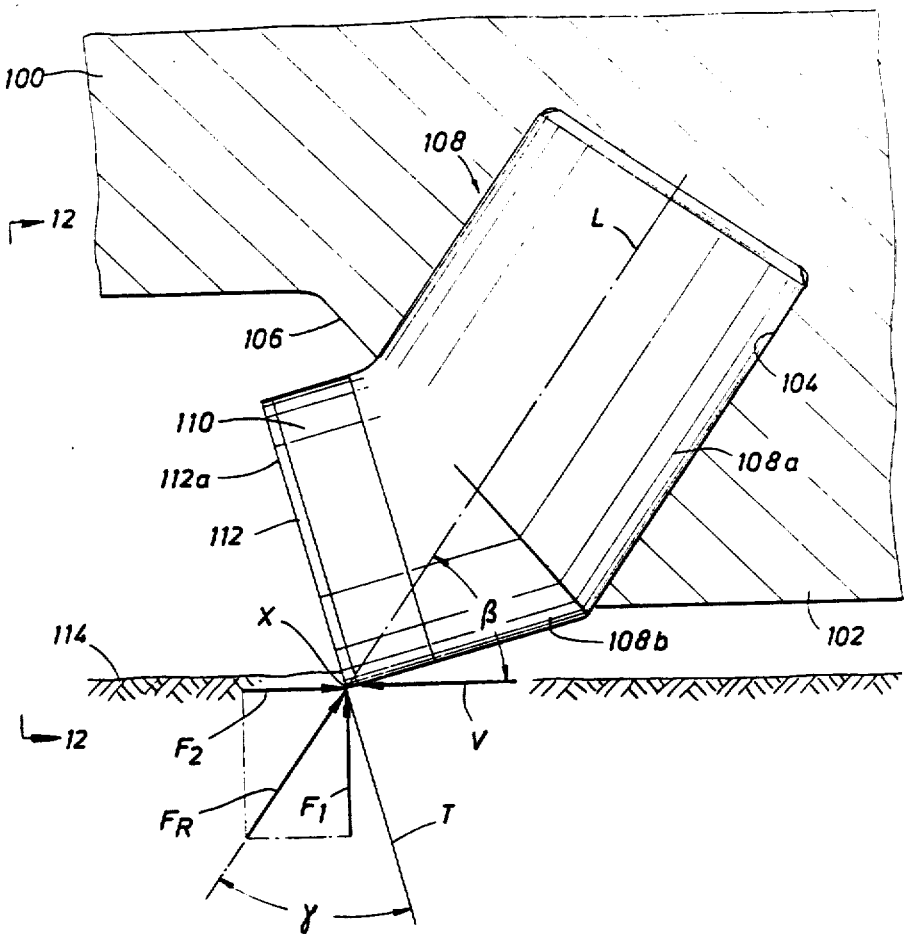
FIG. 11 is a detailed view of another embodiment, showing the cutting member in lateral side elevation and the adjacent portion of the bit body in section in the central plane of the cutting member.
Figure 12:
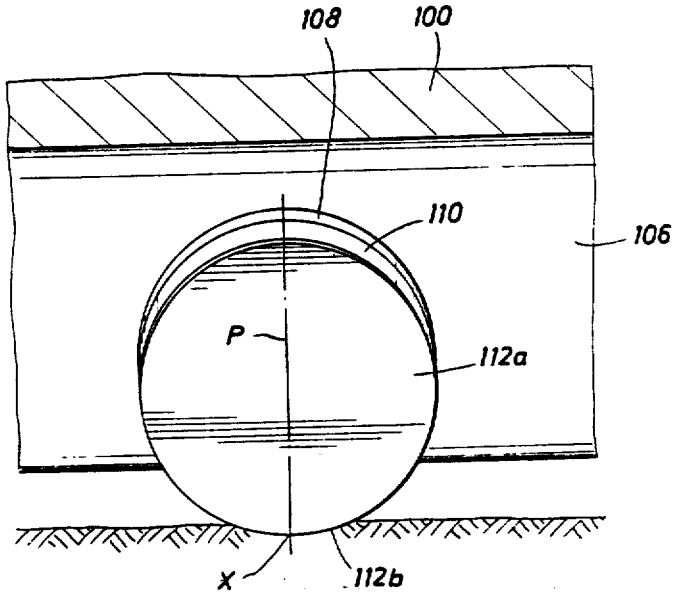
FIG. 12 is a front view taken along the line 12—12 in FIG. 11.

FIGS. 11 and 12 disclose another embodiment of cutting member and its relation to a bit body, along with vectors and construction lines useful in describing a further aspect of the present invention. In particular, there is disclosed a portion of a bit body 100 having on its operating end face an upset or rib 102 in which there is formed a pocket or recess 104. The mouth of recess 109 opens through the leading edge 106 of rib 102. Again, the bit body 100, as illustrated, may be considered to be comprised of a suitable metal such a steel. However, it is specifically noted that the aspects of the invention which are described and illustrated in connection with FIGS. 11 and 12 are also well suited to use in bits in which the bit bodies are formed of tungsten carbide matrix or other materials. It should be understood that the bit body 100 could otherwise be more or less similar to the bit bodies described and illustrated above, and in particular, that rib 102 would have a significant radial component of direction, that there would be other such ribs on the end face of the bit body, and that at least some of these ribs would have a number of recesses such as 104 therein.

FIGS. 11 and 12 further illustrate a cutting member comprising a mounting body 108 of sintered tungsten carbide, a carrier 110 also of sintered tungsten carbide, and a thin layer 112 of polycrystalline diamond material which defines the cutting formation or cutting face 112a, which in turn terminates in a cutting edge 112b. The mounting body 108 includes an innermost, generally cylindrical, stud portion 108a which is encased by and affixed within pocket 104. Stud portion 108a may be mounted in pocket 104 by interference fitting, particularly if the bit body 100 is of steel. Alternatively, particularly if a tungsten carbide matrix bit body is used, stud portion 108a may be brazed into pocket 104, in which case, for purposes of this description, the stud portion of the mounting body will still be considered to be in abutment with the walls of the pocket, even though there may be a thin layer of braze material therebetween.

Mounting body 108 further includes an outermost portion 108b which is angularly oriented with respect to stud portion 108a. Carrier 110 is affixed to the outer end surface of portion 108b, and cutting layer 112 is in turn affixed to the outer surface of carrier 110.

As the cutting edge 112b of the cutting face 112a engages and cuts the earth formation 114 in use, the travel or movement caused by rotation of the bit defines a forward direction. The direction of travel for all points on the cutting face will be parallel or nearly parallel, depending upon the configuration of the cutting face, but for purposes of precise definition in this description, reference will be made to the direction of travel of the midpoint X of the cutting edge 112b. Point X lies in the central plane P of the cutting member, which plane also passes through the centerline L of stud portion 108a and bisects the cutting member into two identical symmetrical halves. The direction of travel of point X is indicated by vector V.

As the cutting edge 112b engages and cuts the earth formation 114, high forces are exerted on the cutting member in two major directions. Due to the weight of the drill string bearing down on the bit and its cutting members, there is a force $F_1$ exerted generally upwardly normal to the earth formation. Due to the forward travel of the cutting edge 112b and its scraping against the earth formation 114, there is a force $F_2$ exerted in a rearward direction. The resultant of the two forces is represented by the vector $F_R$ which is inclined upwardly (i.e. inwardly with respect to the bit) and rearwardly.

In accord with the present invention, the centerline L of stud portion 108a and its mating pocket 104 are likewise rearwardly inclined, with respect to the direction of travel or movement V, from the outer to the inner end of the stud portion, at a first angel $\beta$. (In this specification, unless otherwise noted, the angle between two lines will be considered to be the smaller of two complementary angles formed by the intersection of those lines.)

By virtue of such inclination at angle $\beta$, the bending and shear effects of force $F_R$ are decreased while its compressive effect is increased. Although the exact inclination of vector $F_R$ may vary during use of the bit, it will, for reasons previously explained, always be rearwardly and inwardly inclined. Thus, if the inclination of line L with respect to vector V is likewise rearward and inward, the cutting member will always be placed more in compression and less in shear, as compared to prior art arrangements wherein the stud portions of the mounting bodies were disposed generally normal to the profile of the earth formation.

Furthermore, the cutting face 112a is inclined with respect to centerline L of stud portion 108a, at a second angle, which preferably differs from the angles utilized in standard or conventional cutting members. Because the cutting face 112a as illustrated is planar, the aforementioned second angle is constant for all points on the cutting face for the particular embodiment shown. However, again for purposes of specific and accurate definition, and to account for variations in which the cutting face might be curved, reference will be had to a second angle $\gamma$ between the centerline L and a tangent T to cutting face 112b taken at point X and in the central plane P.

By suitable choice and correlation of the first and second angles $\beta$ and $\gamma$, it is possible to place the cutting member as much in compression as possible, utilizing educated estimates of the direction of the average resultant force $F_R$, while at the same time, providing desirable back rake angles of cutting face 112a.

As is well known in the art, a cutting face may be oriented so as to have some degree of side rake and/or back rake. "Side rake" can be technically defined as the complement of the angle between (1) a given cutting face (or tangent thereto) and (2) a vector in the direction of motion of said cutting face in use, the angle being measured in a plane tangential to the earth formation profile at the closest adjacent point. As a practical matter, a cutting face has some degree of side rake if it is not aligned in a strictly radial direction with respect to the end face of the bit as a whole, but rather, has both radial and tangential components of direction.

"Back rake" can be technically defined as the angle between (1) the cutting face (or a tangent thereto) and (2) the normal to the earth formation profile at the closest adjacent point, measured in a plane containing the direction of motion of the cutting member, e.g. a plane perpendicular to both the cutting face and the adjacent portion of the earth formation profile (assuming a side rake angle of zero degrees). If the aforementioned normal falls within the cutting member, then the back rake is negative; if the normal falls outside the cutting member, the back rake is positive. As a practical matter, back rake can be considered a canting of the cutting face with respect to the adjacent portion of the earth formation profile, with the rake being negative if the cutting edge is the trailing edge of the overall cutting face in use and positive if the cutting edge is the leading edge.

For accomplishing the two aforementioned purposes, i.e. of placing the cutting member more nearly in compression in use while also providing a desirable back rake angle, the first angle $\beta$ should preferably be kept within a range of 80° to 30° inclusive, and even more preferably, from 65° to 50° inclusive. The second angle $\gamma$ should preferably be kept within a range of 18° to 75° inclusive, and even more preferably, a range of 25° to 60° inclusive. Popular back rake angles for planar cutting faces are −20°, −10° and 0°. If the back rake angle is to be approximately −20°, second angle $\gamma$ should be from 38° to 75° inclusive, and even more preferably, from 45° to 60° inclusive. If the back rake angle is to be −10° or thereabouts, $\gamma$ should be from 28° to 65° inclusive, and more preferably, from 35° to 50° inclusive. If the back rake angle is to be approximately 0°, $\gamma$ should be from 18° to 55° inclusive, and more preferably from 25° to 40° inclusive.

Referring still to FIGS. 11 and 12, and comparing those two figures, it can be seen that the preferred choices of angles $\beta$ and $\gamma$ have been utilized while still providing substantial back support and lateral support for the cutting member. In particular, it can be seen that substantial bit body material within the rib or upset 102 backs or lies rearwardly of the cutting face 112*a* over a major portion of the extent of that cutting face. Referring once again to FIG. 9, by eliminating the angular portion (108*b*) of the mounting body, while allowing the recess 32' to open partially through the outer surface of the rib 26*a'* as well as through its leading end surface 28*a'*, a a wide range of angles $\beta$ and $\gamma$ can be accommodated while providing an even greater degree of surrounding of the outer end of the mounting body 36' by the material of the bit body. In either case, since such surrounding and support, and the aforementioned angles, particularly first angle $\beta$, both serve to help prevent shearing and breakage of the cutting members in use, the use of these two aspects of the present invention in concert is particularly advantageous, although they can be used separately.

Other modifications will suggest themselves to those of skill in the art. For example, in the preferred embodiment shown, the profile of the end face of the bit body is such that all cutting members 34 may be mounted in the ribs 26*a*–26*m*. In other designs, e.g. with relatively wider flow paths and fewer ribs, some cutting members may be mounted elsewhere than in the ribs. However, it is nevertheless desirable that at least a majority of the cutting members be mounted in the ribs. In other modifications, the upsets may be in forms other than elongate ribs. Materials, preferably super hard materials such as cubic boron nitrate or boron carbon, may be used as alternatives to the diamond layers described above. Accordingly, it is intended that the scope of the present invention be limited only by the claims which follow.

What is claimed is:

1. A drag-type drill bit comprising:

a bit body adapted for rotative movement in a predetermined direction in use and having an operating end face;

and a plurality of cutting members mounted in said bit body, each of said cutting members having a stud portion disposed in a respective recess in said bit body and defining the inner end of said cutting member, and a cutting face generally adjacent the outer end of the cutting member facing outwardly through said end face of said bit body and terminating in an outermost cutting edge, the centerline of said stud portion being rearwardly inclined from said outer end to said inner end with respect to said direction of movement in use—taken at the midpoint of said cutting edge—at a first angle from 80° to 30° inclusive;

and said cutting face being oriented such that the tangent to said cutting face at the midpoint of said cutting edge and in the central plane of the cutting member, is disposed at a second angle, from 18° to 75° inclusive, with respect to the centerline of said stud portion.

2. The apparatus of claim 1 wherein said cutting face has a back rake angle at said cutting edge of about −20°, and wherein said second angle is from 38° to 75° inclusive.

3. The apparatus of claim 1 wherein said cutting face has a back rake angle at said cutting edge of about −10°, and wherein said second angle is from 28° to 65° inclusive.

4. The apparatus of claim 1 wherein said cutting face has a back rake angle at said cutting edge of about 0°, and wherein said second angle is from 18° to 55° inclusive.

5. The apparatus of claim 1 wherein said first angle is from 65° to 50° inclusive, and wherein said second angle is from 25° to 60° inclusive.

6. The apparatus of claim 5 wherein said cutting face has a back rack angle at said cutting edge of about −20°, and wherein said second angle is from 45° to 60° inclusive.

7. The apparatus of claim 5 wherein said cutting face has a back rack angle at said cutting edge of about −10°, and wherein said second angle is from 35° to 50° inclusive.

8. The apparatus of claim 5 wherein said cutting face has a back rake angle at said cutting edge of about 0°, and wherein said second angle is from 25° to 40° inclusive.

9. The apparatus of claim 1 wherein said end face of said bit body includes a plurality of upsets each having a leading edge surface and at least one recess extending through each such leading edge surface, said end face of said bit body further comprising a plurality of flow paths, each of said leading edge surfaces having one of said flow paths extending therealong and inset therefrom;

and wherein each of said cutting members has its stud portion mounted in a respective one of said recesses, with its cutting face facing generally outwardly along said leading edge surface of said upset.

10. The apparatus of claim 9 wherein each of said stud portions has a significant part thereof, opposite said cutting face, embedded in and supported by the material of said bit body in the respective one of said upsets.

11. The apparatus of claim 10 wherein the walls of each of said recesses abut the respective stud portion about more than 180° of its periphery measured in a plane transverse to and intersecting said cutting face.

12. The apparatus of claim 9 wherein the walls of each of said recesses abut the respective stud portion about more than 180° of its periphery measured in a plane transverse to and intersecting said cutting face.

13. The apparatus of claim 9 wherein said upsets are elongate ribs each arranged to have a substantial radial component of direction, with respect to said end face of said bit body, at each point along its length, and wherein said cutting faces are fully exposed along said leading edge surfaces of said ribs.

14. The apparatus of claim 13 wherein said bit body has a plurality of circulation ports opening through said end face and communicating with said flow paths, the number of said ports being less than the number of flow paths extending along said leading edge surfaces of said ribs, and at least some of said ports communicating with more than one such flow path.

15. The apparatus of claim 14 wherein said bit body has a central longitudinal bore, and wherein said ports are defined by rectilinear bores each intersecting said central bore and each intersecting said end face of said bit body at an angle of about 0° to 40° from the normal to the bit body at the point of such intersection.

16. The apparatus of claim 15 wherein each of said ports is located a different radial distance from the centerline of said bit body.

17. A drag-type drill bit comprising:

a bit body adapted for rotative movement in a given direction in use and having an operating end face;

and a plurality of cutting members mounted in said bit body, each of said cutting members having a stud portion disposed in a respective recess in said bit body and defining the inner end of said cutting member, and a cutting face generally adjacent the outer end of said cutting member, facing outwardly from said end face of said bit body, and defining an outermost cutting edge;

the centerline of said stud portion being rearwardly inclined from the outer end to the inner end of said cutting member with respect to said direction of movement in use—taken at the midpoint of said cutting edge—at an angle from 65° to 50° inclusive.

18. A cutting member for use in a drag-type drill bit comprising:

a stud portion defining one end of said cutting member;

a cutting face generally adjacent the other end of said cutting member and defining an outermost cutting edge;

said cutting face being oriented such that the tangent to said cutting face at the midpoint of said cutting edge and in the central plane of the cutting member is disposed at an angle from 36° to 60° inclusive with respect to the centerline of said stud portion.

* * * * *

UNITED STATES PATENT AND TRADEMARK OFFICE

CERTIFICATE OF CORRECTION

PATENT NO. : 4,640,375

DATED : February 3, 1987

INVENTOR(S) : John D. Barr et al.

It is certified that error appears in the above-identified patent and that said Letters Patent is hereby corrected as shown below:

The sheet of drawings consisting of Figures 11 and 12 should be added as shown on the attached sheet.

Signed and Sealed this

Second Day of February, 1988

*Attest:*

DONALD J. QUIGG

*Attesting Officer*

*Commissioner of Patents and Trademarks*

'atent No. 4,640,375

February 3, 1987

John D. Barr et al.